United States Patent [19]

Zäpfel et al.

[11] Patent Number: 4,888,966

[45] Date of Patent: Dec. 26, 1989

[54] THROUGHFEED SAMMYING PRESS

[75] Inventors: Horst Zäpfel, Karlsruhe; Erich Cabelmann, Kronberg, both of Fed. Rep. of Germany

[73] Assignee: Maschinenfabrik Moenus-Turner gmbH, Oberursel, Fed. Rep. of Germany

[21] Appl. No.: 230,174

[22] Filed: Aug. 9, 1988

[30] Foreign Application Priority Data

Aug. 12, 1987 [DE] Fed. Rep. of Germany ..... 3726757

[51] Int. Cl.[4] ..... C14B 1/32

[52] U.S. Cl. ..... 69/41; 69/48; 100/118

[58] Field of Search ..... 69/33, 41, 42, 44, 48; 100/118, 121

[56] References Cited

U.S. PATENT DOCUMENTS

| | | | |
|---|---|---|---|
| 2,358,334 | 9/1944 | Knowlton | 69/41 X |
| 3,654,781 | 4/1972 | Plechac | 69/41 |
| 4,055,059 | 10/1977 | Dokoupil | 69/41 |
| 4,100,773 | 7/1978 | Repetto | 69/48 |
| 4,208,892 | 6/1980 | Becker | 69/48 |
| 4,427,157 | 1/1984 | Klein | 100/118 X |
| 4,475,453 | 10/1984 | Davis | 100/118 |
| 4,697,511 | 10/1987 | Davis et al. | 100/118 X |

FOREIGN PATENT DOCUMENTS

| | | | |
|---|---|---|---|
| 3427002 | 1/1986 | Fed. Rep. of Germany | 69/48 |
| 569597 | 8/1977 | U.S.S.R. | 69/48 |

OTHER PUBLICATIONS

*Through Feed Sammying Press*, Brochure No. 594 of Moenus-Turner, Frankfurt, Germany, 1982.

*Primary Examiner*—Wm. Carter Reynolds
*Attorney, Agent, or Firm*—Peter K. Kontler

[57] ABSTRACT

Skins, hides and similar flexible objects are sammied during travel through two successive nips the first of which is defined by an upper pressure roll and a first lower pressure roll and the second of which is defined by the upper pressure roll and a second lower pressure roll. A first endless belt of felt or other absorbent material is trained over the upper pressure roll and a second endless belt of felt or other absorbent material is trained over the second lower pressure roll. A liquid-permeable object-supplying endless belt conveyor has an upper reach which advances through the two nips and has a portion which overlies the second endless belt downstream of the second nip.

11 Claims, 1 Drawing Sheet

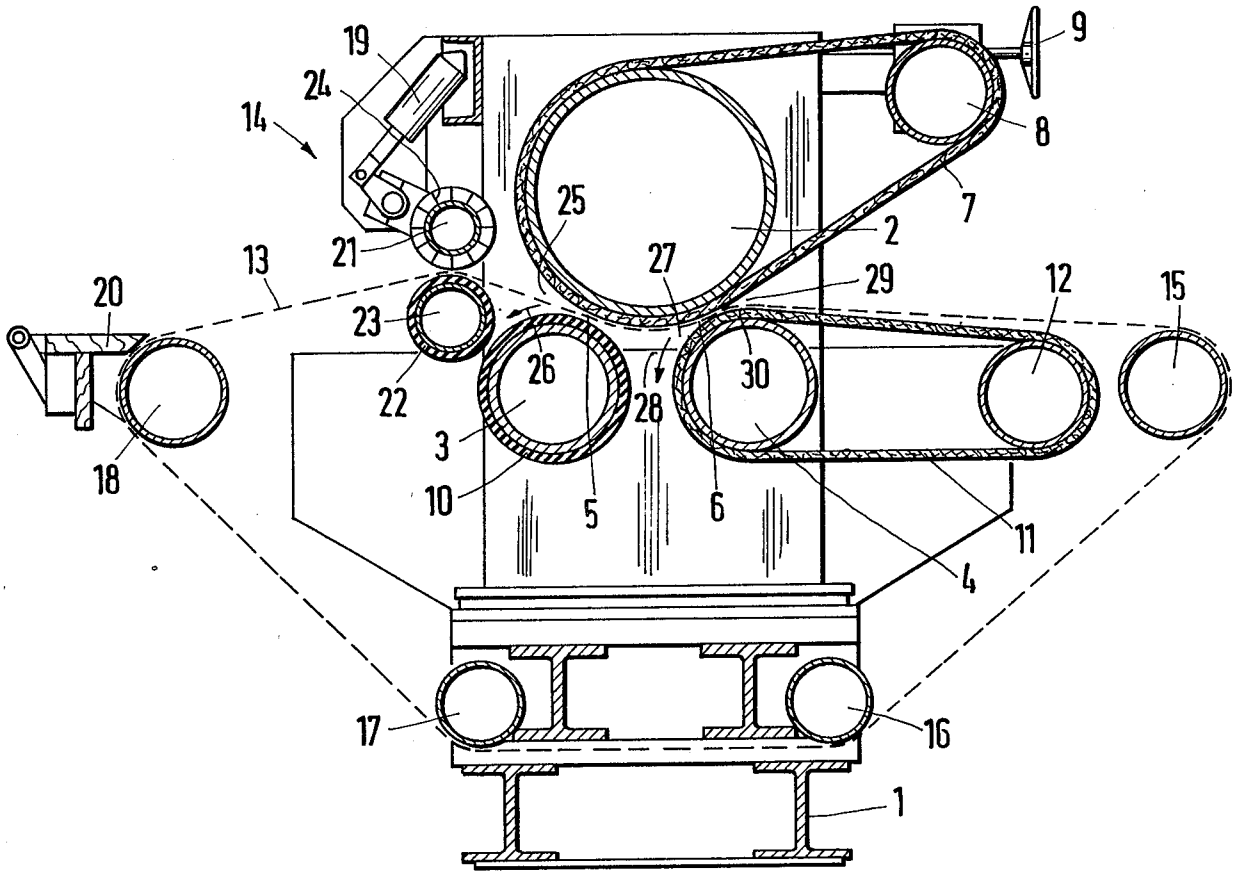
1
2
3
4
5
6
7
8
9
10
11
12
13
14
15
16
17
18
19
20
21
22
23
24
25
26
27
28
29
30

THROUGHFEED SAMMYING PRESS

BACKGROUND OF THE INVENTION

The present invention relates to sammying presses in general, and more particularly to improvements in so-called through-feed sammying presses. Still more particularly, the invention relates to improvements in sammying presses of the type wherein the objects to be treated (such as whole hides, skins, sides, butts and shoulders) are caused to advance through at least one nip to be relieved of surplus liquids. As a rule, sammying machines are used for expulsion of surplus liquids from and/or for uniform distribution of liquids in leather or in objects which are to be processed into leather; however, such presses can also be used for the treatment of other commodities which contain a surplus of liquid and/or wherein the distribution of liquid must be changed in response to the application of mechanical pressure.

German-English language Brochure No. 594 of Maschinenfabrik MOENUS-TURNER GmbH, Frankfurt, Federal Republic of Germany (published in 1982 and having the English title "Through-feed Sammying Press") describes a through-feed sammying press which is distributed by the assignee of the present application and wherein a single upper pressure roll cooperates with two lower pressure rolls to define two nips for the passage of hides, skins and like flexible commodities. A first endless belt conveyor which is made of felt is trained over the upper pressure roll and extends through both nips. A larger second endless belt conveyor, which is also made of felt, is trained over the lower pressure rolls and its upper reach or stretch serves for introduction of successive objects into the upstream nip. The upper reach of the second endless belt conveyor extends through both nips. The just described press operates quite satisfactorily except that the removal of surplus liquid from objects which emerge from the second nip can present certain problems. Furthermore, the felt of the second endless belt conveyor prevents the water pressed out at the entrance of the nips from a free flow-off.

Published German patent application No. 25 38 703 of Dokoupil (corresponding to U.S. Pat. No. 4,055,059) discloses a sammying press wherein the objects to be sammied are caused to advance between a hollow upper pressure roll, which contains two smaller pressure rolls, and a pair of lower pressure rolls. A first endless felt band is trained over the hollow upper pressure roll and a pulley, and a second endless felt band is trained over one of the lower pressure rolls and further extends through the nip of the hollow upper pressure roll and the other lower pressure roll. The second endless felt band serves to transport objects into and beyond the two nips. The disadvantages are the same as mentioned before.

Published German patent application No. 20 10 823 Plechac (corresponding to U.S. Pat. No. 3,654,781) discloses a sammying press wherein the upper pressure roll and each of two lower pressure rolls carries an outer layer of felt and wherein a foraminous belt conveyor is used to deliver objects into the nips of the lower pressure rolls with the upper pressure roll. After leaving the second press nip, the objects are held in contact with the felt of the upper pressure roll for a distance in order to remove additional water from the objects. This press exhibits the advantage of a free flow-off of the water pressed out at the entrance of the nips. However, after leaving the second nip the objects to be sammied are wetted by water retained in the holes of the belt conveyor. The more water is absorbed by the felt of the upper pressure roll, the more water must be pressed back through the objects at the entrance of the first nip. Therefore, the dewatering effect is limited.

U.S. Pat. No. 3,613,564 of Adamski et al. discloses a sludge dewatering apparatus wherein the material to be dewatered is caused to advance between the lower reach of an upper screen belt and the upper reach of a lower screen belt. The lower reach of the upper screen belt is adjacent the lower reach of an upper foam belt, and the upper reach of a lower foam belt is adjacent the underside of the upper reach of the lower screen belt. Such apparatus are not suitable for the sammying of leather because the foam belts are not permitted to directly contact the commodities which are to be relieved of surplus liquid.

OBJECTS OF THE INVENTION

An object of the invention is to provide a through-feed sammying press which is constructed and assembled in such a way that it can reliably remove required quantities of liquids from hides, skins and similar flexible objects.

Another object of the invention is to provide a press wherein the objects are treated gently and which can be used for the sammying of a wide variety of flexible objects.

An additional object of the invention is to provide the press with novel and improved means for removing expelled surplus liquid from the sammying station.

A further object of the invention is to provide the press with novel and improved means for delivering spread-out objects to the sammying station.

Still another object of the invention is to provide a novel and improved method of sammying skins, hides and the like in a through-feed press.

SUMMARY OF THE INVENTION

The invention is embodied in a sammying press for hides, skins and similar flexible objects. The improved press comprises a frame, a first pressure applying unit including at least one first pressure roll which is mounted in the frame, a second pressure applying unit including at least one second pressure roll which is mounted in the frame and defines with the at least one first pressure roll a nip for the passage of objects to be sammied, a first liquid-absorbent band which extends through the nip adjacent the at least one first pressure roll, a second liquid-absorbent band extending through the nip adjacent the at least one second pressure roll, and means for feeding objects in a direction into, through and beyond the nip. The feeding means includes a liquid-permeable (e.g., sieve-like) endless belt conveyor having an elongated reach which extends between the first and second absorbent bands and through the nip. One of the first and second pressure rolls and the respective absorbent band are disposed within the confines of the conveyor, i.e., such conveyor surrounds one of the pressure rolls and the respective absorbent band. At least one of the absorbent bands can contain felt. The at least one first pressure roll and the first band can be disposed at a level above the at least one second pressure roll, the second band and the aforementioned reach of the conveyor.

A portion of the elongated reach of the conveyor preferably overlies (and can actually contact) a portion of the second band in the region immediately downstream of the nip.

The second pressure applying unit can further comprise an additional second pressure roll which is mounted in the frame and defines with the first pressure applying unit a second nip located upstream of the nip of the at least one first pressure roll and the at least one second pressure roll. The elongated reach of the conveyor extends through the second nip between the additional second pressure roll and the first liquid-absorbent band. The additional second pressure roll is preferably surrounded by the conveyor, and the first band can include an endless belt which is trained over the at least one first pressure roll. The elongated reach of the liquid-permeable conveyor can be guided in such a way that it comes in contact with the additional second pressure roll only close to and upstream of the second nip. If the first pressure applying unit comprises a single first pressure roll, the second nip is defined by such single first pressure roll and the additional second pressure roll.

The press preferably further comprises suitable spreading means which serves to prevent pleating of the objects to be sammied and is disposed upstream of the nip of the at least one first pressure roll and the at least one second pressure roll. If the press defines two nips, the spreading means is preferably installed upstream of the second (upstream) nip.

The novel features which are considered as characteristic of the invention are set forth in particular in the appended claims. The improved sammying press itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE of the drawing is a vertical sectional view of a through-feed sammying press which embodies the invention.

DESCRIPTION OF PREFERRED EMBODIMENTS

The through-feed sammying press which is shown in the drawing comprises a frame 1 which supports a first or upper pressure applying unit and a second or lower pressure applying unit. The first pressure applying unit comprises a single pressure roll 2 which is mounted in the frame 1 for rotation about a horizontal axis and constitutes one pulley for an endless band 7 which is made of or contains felt or any other suitable liquid-absorbent material and is further trained about a guide roller or pulley 8 which is movable in the frame 1 along a substantially horizontal path. A stretching device for the endless band 7 includes a hand wheel 9 which can be rotated to move the pulley 8 nearer to or further away from the pressure roll 2.

The second or lower pressure applying unit comprises two pressure rolls 3 and 4 which define with the upper pressure roll 2 a first nip 5 and a second nip 6, the latter being located downstream of the nip 5 as seen in the direction of advancement of objects (such as hides, skins, sides, butts or shoulders) which are to be sammied in the improved press. Conventional pneumatic cushions (not shown in the drawing) are provided to bias the lower pressure rolls 3 and 4 toward the upper pressure roll 2 with a variable force so as to ensure that the objects which pass through the nips 5 and 6 are subjected to compressive stresses of preselected magnitude. The pressure roll 3 has a coat 10 of rubber or other suitable elastomeric material.

The press further comprises a second endless band 11 of liquid-absorbent material which is trained over the lower pressure roll 4 and over a guide roller or pulley 12, the latter being reciprocally mounted in the frame 1 and being movable toward or away from the pressure roll 4 in order to change the tension of the band 11. The means for tensioning the band 11 through the medium of the pulley 12 can include a second hand wheel (similar to the hand wheel 9) which is not shown in the drawing.

The means for feeding objects in a direction from the left toward, into and beyond the nips 5 and 6 comprises an endless liquid-permeable belt conveyor 13 which can constitute a sieve and has an elongated upper reach extending through the nips 5 and 6. The conveyor 13 surrounds the lower pressure rolls 3, 4 and the lower endless band 11 and is trained over four guide rollers or pulleys 15, 16, 17, 18 which are rotatably mounted in the frame 1. The upper reach of the conveyor 13 further extends through a spreading unit 14 which is installed in the frame 1 ahead of the first nip 5 and serves to prevent pleating of, or to eliminate pleats or folds from, the objects which are about to enter the nip 5. At least one of the pulleys 15–18 is adjustably mounted in the frame 1 and can be moved by a hand wheel or the like (not shown) so as to alter the tension of the conveyor 13 (if and when necessary).

The pulley 18 is adjacent a table 20 which can serve as a support for hides or other objects to be treated in the improved press while advancing through the nips 5 and 6. The table 20 is located ahead of the spreading device 14 which comprises a spreading cylinder 21 which is mounted in the frame 1 above the upper reach of the conveyor 13, a lower cylinder 23 which is disposed beneath the upper reach of the conveyor 13 opposite the spreading cylinder 21 and has an elastic coat 22 of rubber or the like, and a fluid-operated (e.g., pneumatic) motor 19 which can be actuated to move the spreading cylinder 21 toward or away from the cylinder 23 through the medium of a suitable linkage. The periphery of the cylinder 21 is provided with helical spreading elements 24 in the form of blades including a first set surrounding one half of the core of the cylinder 21 and having a first lead, and a second set surrounding the other half of the core of the cylinder 21 and having a second lead counter to the first lead. This ensures that a hide which is delivered into the range of the cylinder 21 is relieved of pleats and is thus flattened to enter the first nip 5 in an optimum condition for expulsion of excess moisture.

The improved press is operated as follows:

An object (such as a whole hide) which requires treatment is placed onto the table 20 and is caused to advance onto the upper reach of the conveyor 13 which is driven by at least one of the pulleys 15–18 so that the upper reach advances in a direction to the right. The spreading device 14 ensures that the object is relieved of pleats not later than when it enters the nip 5. This is achieved in that one-half of the object is pulled (by the spreading elements 24) toward and the other half of the object is pulled away from the observer of the drawing.

The aforementioned pneumatic cushioning means biases the pressure roll 3 toward the pressure roll 2 so that a liquid wave develops in the space 25 at the inlet to the first nip 5, and such wave is evacuated in the direction of arrow 26. The wave develops in part above and in part below the upper reach of the conveyor 13. The upper part of the wave passes through the holes or interstices of the conveyor 13 and is evacuated with the lower part by flowing in the direction of arrow 26.

The upper reach of the conveyor 13 thereupon advances successive increments of the partially treated object toward and into the inlet 27 of the second nip 6. This causes the object to release additional liquid (such as water) which forms a second wave beneath the upper reach of the conveyor 13. The second wave is evacuated from the press in the direction of arrow 28. As a rule, the second wave is much smaller than the first wave.

The material of the bands 7 and 11 undergoes pronounced compression during advancement through the nip 6, and such material is permitted to expand rather abruptly immediately downstream of the nip 6 i.e., at the outlet 29 of this nip. The expanding lower band 11 sucks liquid from the adjacent portion of the upper reach of the conveyor 13 as well as from the object which advances into and beyond the outlet 29 of the nip 6. The expanding material of the upper band 7 sucks liquid from the object on the upper reach of the conveyor 13. The liquid-collecting action of the lower band 11 is enhanced in that a portion of the upper reach of the conveyor 13 overlies the band 11 in the region 30, i.e., immediately downstream of the nip 6 between the pressure rolls 2 and 4. The length of the portion 30 of direct overlap between the conveyor 13 and band 11 downstream of the nip 6 can be altered by raising or lowering the pulley 15.

The upper reach of the conveyor 13 not only constitutes a means for advancing the objects from the table 20, through the spreading device 14 and into and beyond the nips 5, 6 but it also constitutes a means for reducing friction between the objects and the pressure roll 3 as well as between the objects and the band 11. Still further, the upper reach of the conveyor 13 enables the objects to expand transversely of the direction of their movement toward the nip 5 under the action of the spreading elements 24 in order to be relieved of folds, pleats and similar irregularities. Such sidewise movements of the objects on the upper reach of the conveyor 13 can take place with a minimum of friction because the outer side of the conveyor 13 is or can be a smooth surface.

It has been found that the conveyor 13 contributes to longer useful life of several component parts of the press. This is due to the fact that the upper reach of the conveyor 13 constitutes a mobile barrier between the upper band 7 and the elastic outer coat or layer 10 of the pressure roll 3. In addition, the upper reach of the conveyor 13 constitutes a mobile barrier between the bands 7 and 11 in the region of the second or downstream nip 6. This reduces friction and wear upon the elastic layer 10 and upon the bands 7, 11.

The improved sammying press can be modified in a number of ways without departing from the spirit of the invention. For example, the lower pressure roll 3 can be omitted or deactivated if the objects to be sammied can be adequately treated during advancement into the nip 6 of the pressure rolls 2 and 4. Alternatively, the press can be provided with one or more additional upper and/or lower pressure rolls if it is necessary to treat hides, skins or like objects by causing them to advance through three or more successive nips. As a rule, the sammying action is not appreciably improved or enhanced if the number of nips is increased from two to three or more. Still further, each of two or more successive nips can be formed by a pair of discrete pressure rolls, i.e., the upper roll 2 can constitute one of two rolls in the first or upper pressure applying unit of the improved sammying press.

The exact manner in which the conveyor 13 and/or the band 7 and/or 11 can be driven forms no part of the invention. As mentioned above, the conveyor 13 can be driven by one of the pulleys 15–18, and the conveyor 13 can transmit motion to the bands 7, 11, to the roll 3 and to the cylinders 21, 23 of the spreading unit 14.

An important advantage of the conveyor 13 is that it enables the upper part of the first liquid wave which develops in the space at the inlet 25 of the first nip 5 to flow through the upper reach of the conveyor and to be evacuated with the lower part of the first wave in the direction of arrow 26. As a rule, the major percentage of liquid which is to be expelled from the objects is evacuated during entry into the nip 5.

The bands 7 and 11 exhibit the advantage that they can absorb (directly from the objects as well as from the upper reach of the conveyor 13) those remnants of liquid which enter the outlet 29 of the second nip 6, i.e., that percentage of liquid which is to be gathered and removed in addition to the two liquid waves which are evacuated in directions indicated by the arrows 26 and 28. It has been found that the improved press can remove requisite quantities of liquid with a higher degree of reliability and predictability than heretofore known presses.

Another important advantage of the improved press is that it can treat objects while they advance with the upper reach of the conveyor 13 at a relatively high speed. Alternatively, and if it is desired to reduce the pressures in the nips 5 and 6, the conveyor 13 is simply driven at a lower speed so as to prolong the periods of dwell of successive increments of the objects at the sammying station. Operation at a reduced pressure is desirable in connection with the treatment of certain types of sensitive hides, skins, leathers or like commodities; in addition, operation at a lower pressure contributes to longer useful life of the bands 7 and 11.

In many presently known sammying presses, the means for feeding objects into the foremost nip includes an endless felt conveyor. Such conveyor is likely to define with the objects thereon pockets for entrapped moisture which cannot escape during travel through the nip or nips. The entrapped pockets of moisture cause the development of undesirable sickle-shaped wrinkles which normally develop in the most valuable central portions of the hides. It has been found that the just discussed liquid-containing pockets do not develop if the press is provided with an object feeding means which is a liquid-permeable conveyor. As mentioned above, such conveyor permits a hide to spread out during travel between the cylinders 21 and 23 of the device 14 so that the hide is devoid of pleats during entry into the first nip 5. This contributes significantly to the quality of the treated commodities and reduces the percentage of hides which must be discarded or which cannot be used for the making of expensive high-quality leather products.

The material of the conveyor 13 and its surface finish are preferably selected in such a way that friction between the conveyor and a hide or between the conveyor and a band which is made of felt or a like absorbent material is but a fraction of friction which develops when a hide rubs directly against a felt band or when a first felt band rubs against a second felt band. This ensures that the hides can be shifted relative to the upper reach of the conveyor 13 and/or that the upper reach of the conveyor can be shifted relative to the bands 7, 11 and/or that the bands 7, 11 can be shifted relative to each other and/or relative to the conveyor and/or relative to the hides with a minimum of resistance (if and when such shifting is desirable and/or necessary). A certain amount of shifting of hides relative to the band 7 and/or conveyor 13 might be necessary if a hide includes thinner and thicker portions which advance along arcuate paths having different radii, e.g., at the six o'clock position of the upper pressure roll 2. The ability of the hides and/or bands 7, 11 to shift relative to the adjacent parts of the press reduces wear upon the bands to prolong their useful life and to entail a reduction of down times of the press.

The conveyor 13 can be made of any one of a wide variety of materials which are capable of forming endless belts adapted to advance hides or like commodities toward and through the spreading unit 14 and through one or more nips at the sammying station and which are capable of providing adequate paths for the passage of moisture therethrough. It is preferred to employ an endless liquid-permeable conveyor which constitutes or resembles a sieve and has smooth internal and external surfaces. The dimensions of holes, perforations, interstices or otherwise configurated openings in the conveyor 13 are preferably such that liquid can pass therethrough by gravity flow, i.e., the conveyor should not gather and retain appreciable quantities of liquid. Sieves which are used in paper making machines can be used with advantage for the transport of commodities through the improved sammying press. It is also possible to employ a conveyor which is made of woven or other suitable textile or other fabrics, especially tightly woven (close-meshed) fabrics. Still further, the conveyor 13 can be made of interlaced plastic spirals.

The (optional but desirable) feature that the upper reach of the conveyor 13 directly overlies a portion of the band 11 in the region (30) immediately downstream of the second nip 6 ensures that the expanding band 11 removes moisture from the adjacent portion of the conveyor 13 as well as from the object at the outlet 29 of the nip 6. The duration of such removal of liquid from the conveyor 13 and/or from the treated object depends upon the selected length of the region 30 and upon the selected speed of the conveyor 13.

As mentioned above, one of the lower pressure rolls 3, 4 also constitutes an optional feature of the improved press. For example, the pressure roll 3 can be omitted so that the objects which are supplied by the upper reach of the conveyor 13 advance toward, through and beyond a single nip (6). The provision of two nips is desirable and advantageous if the removal or expulsion of water and/or other liquids must be carried out with a high degree of precision. The major percentage of liquids is expelled in the nip 5 and is evacuated in the direction of arrow 26. The remnant of moisture is expelled by the pressure rolls 2 and 4 so that the percentage of moisture which remains in the objects advancing beyond the outlet 29 of the second nip 6 is very low.

As can be seen in the drawing, the upper reach of the conveyor 13 contacts the pressure roll 3 in a region which is located immediately ahead of the nip 5. This is desirable and advantageous because a relatively long portion of the upper reach of the conveyor 13 is held out of contact with the band 7 and elastic layer 22 in the region ahead of the nip 5 and is thus capable of permitting large quantities of liquid which forms the upper part of the aforediscussed first wave to pass therethrough and to be evacuated in the direction of arrow 26.

The gap between the lower pressure rolls 3 and 4 is sufficiently wide to permit the liquid forming the second wave to flow by gravity in the direction of arrow 28. As mentioned above, each of the lower pressure rolls 3, 4 can cooperate with a discrete upper pressure roll; the illustrated design of the press is preferred at this time because it contributes to compactness and lower cost.

The conveyor 13 exhibits the additional advantage that it enables the spreading apparatus 14 to reliably eliminate folds, pleats and other irregularities from successive increments of hides or like objects which are about to enter the nip 5. This is due to the fact that friction between the upper reach of the conveyor 13 and a hide is much less pronounced than between a hide and a felt band; therefore, the hides can be properly smoothed with the exertion of relatively small forces to thus reduce the likelihood of damage to the hides in the course of the spreading operation.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A sammying- press comprising a frame; a first pressure applying unit including at least one first pressure roll mounted in said frame; a second pressure applying unit including at least one second pressure roll mounted in said frame and defining with said at least one first pressure roll a nip for the passage of objects to be sammied; a first liquid-absorbent band extending through said nip adjacent said at least one first pressure roll; a second liquid-absorbent band extending through said nip adjacent said at least one second pressure roll; and means for feeding objects in a direction into, through and beyond said nip, including a liquid-permeable endless belt conveyor having a reach extending between said first and second bands and through said nip, one of said first and second pressure rolls and the respective liquid-absorbent band being disposed within the confines of said conveyor.

2. The press of claim 1, wherein at least one of said first and second bands contains felt.

3. The press of claim 1, wherein said at least one first pressure roll and said first band are disposed at a level above said at least one second pressure roll and said second band.

4. The press of claim 3, wherein a portion of said reach of said conveyor overlies a portion of said second band downstream of said nip, as seen in said direction.

5. The press of claim 1, wherein said second pressure applying unit further comprises an additional second pressure roll mounted in said frame and defining with said first unit a second nip upstream of the nip of said at least one first and said at least one second pressure roll, as seen in said direction, said reach of said conveyor extending through said second nip between said additional second roll and said first band.

6. The press of claim 5, wherein said first pressure applying unit and said first band are disposed above said reach of said conveyor and said additional second pressure roll is surrounded by said conveyor.

7. The press of claim 6, wherein said first band includes an endless belt which is trained over said at least one first pressure roll.

8. The press of claim 6, wherein said reach of said conveyor contacts said additional second pressure roll close to and upstream of said second nip, as seen in said direction.

9. The press of claim 5, wherein said additional second pressure roll defines the second nip with said at least one first pressure roll.

10. The press of claim 1 for sammying skins, hides and like flexible objects, further comprising spreading means for preventing pleating of objects on said reach of said conveyor upstream of said nip, as seen in said direction.

11. The press of claim 10, wherein said second unit includes an additional second pressure roll defining with said first unit a second nip upstream of the nip of said at least one first pressure roll and said at least one second pressure roll, said spreading means being disposed upstream of said second nip.

* * * * *